United States Patent [19]

Hubbard et al.

[11] 4,346,256

[45] Aug. 24, 1982

[54] CONDUIT IN SUPPLYING ELECTRICAL POWER AND PRESSURIZED FLUID TO A POINT IN A SUBTERRANEAN WELL

[75] Inventors: Martin G. Hubbard, Corona del Mar; John W. Erickson, Huntington Beach, both of Calif.

[73] Assignee: Kobe, Inc., Commerce, Calif.

[21] Appl. No.: 136,190

[22] Filed: Apr. 1, 1980

[51] Int. Cl.[3] ..... E21B 17/00

[52] U.S. Cl. ..... 174/47; 166/242; 174/100

[58] Field of Search ..... 174/8, 24, 27, 37, 47, 174/68 R, 70 R, 99 R, 100, 111, 116; 138/108; 166/65 R, 77, 176, 241, 242, 243; 175/104, 105; 219/277, 278

[56] References Cited

U.S. PATENT DOCUMENTS

| | | | |
|---|---|---|---|
| 497,852 | 5/1893 | Wright | 174/111 X |
| 536,857 | 4/1895 | Dion | 174/111 |
| 1,750,111 | 3/1930 | Mahlke | 174/111 X |
| 1,912,794 | 6/1933 | Peterson | 174/111 X |

FOREIGN PATENT DOCUMENTS

| | | | |
|---|---|---|---|
| 2394909 | 1/1979 | France | 174/99 R |

*Primary Examiner*—Laramie E. Askin

*Attorney, Agent, or Firm*—William C. Norvell, Jr.

[57] ABSTRACT

A conduit is provided for transmitting both electrical power and pressured hydraulic fluid from the surface to a point in a subterranean well. The conduit comprises an outer housing formed of steel or other high tensile strength material and one or more insulated wires of copper or similar low tensile strength, highly conductive metal which are run through the outer housing. Supports are provided between the external surfaces of the insulated wires and the internal wall of the housing to frictionally anchor the insulated wires to the housing. The supports also define fluid passages therethrough so that pressured fluid may be transmitted through the bore of the housing. So that the wires are gravitationally stabilized within the outer housing, the average density of the supports and the pressured fluid is approximately equal to the average density of the insulated wires.

2 Claims, 7 Drawing Figures

CONDUIT IN SUPPLYING ELECTRICAL POWER AND PRESSURIZED FLUID TO A POINT IN A SUBTERRANEAN WELL

BACKGROUND OF THE INVENTION

1. Field of the Invention

The invention relates to a fluid filled conduit for supplying electrical power and pressured fluid from the surface to a point in a subterranean well.

2. Description of the Prior Art

There are many subterranean wells requiring the operation of electrical equipment in the lower regions of the well. In view of the fact that many modern wells have depth in excess of, for example, five thousand feet, the sheer weight of ordinary insulated wire extended into the well for that distance may cause a severing of the copper or aluminum strands making up the electrical conductor.

In the co-pending application Ser. No. 068,787, filed Aug. 22, 1979, and entitled "Insulating Fluid System For Protecting Submersible Electric Motors From Surrounding Fluids", now U.S. Pat. No. 4,262,226, and assigned to the assignee of this invention, there is disclosed a combined electrical power and fluid conduit for supplying both electrical power and pressured oil to a point, such as to a pump motor located in the bottom regions of a well. When such pump motor is located in a deep well, it may become necessary to provide some form of auxiliary support for the conduit enclosed electrical wires to prevent their breaking under the stress of their own weight, but at the same time, the supporting structure employed cannot interfere with the passage of the pressured fluid through the external housing down to the pump motor.

SUMMARY OF THE INVENTION

The invention provides a dual purpose conduit for subterranean wells that is capable of transmitting both electrical power and pressured fluid to apparatus located down hole. The tensile force created by the weight of the conduit components is absorbed by an external housing, through which one or more insulated electrical wires are run. Support means are provided between the external surface of the electrical wires and the internal surfaces of the housing to frictionally support the wires by the housing to prevent the weight of the wires creating tensile stresses sufficient to sever the wires. The support means are further provided with passages to permit the passage of pressured fluid through the bore of the housing to the apparatus disposed within the well.

In one modification of the invention, the support means comprises a plurality of spheres having a lead or other comparatively high density interior and an elastomeric, compressible exterior, so that the wires are gravitationally stabilized in the pressured fluid and do not float substantially within the housing. In other modifications, the compressible support members comprise C-shaped or segment-shaped elements which are compressible to be frictionally engageable with the external surfaces of the insulated electric wires and also with the interior walls of the housing. All such compressible elements permit fluid flow therethrough so as to permit the passage of pressured fluid down through the bore of the housing.

DESCRIPTION OF THE PREFERRED EMBODIMENTS

Figures 1, 2, 3, 4:
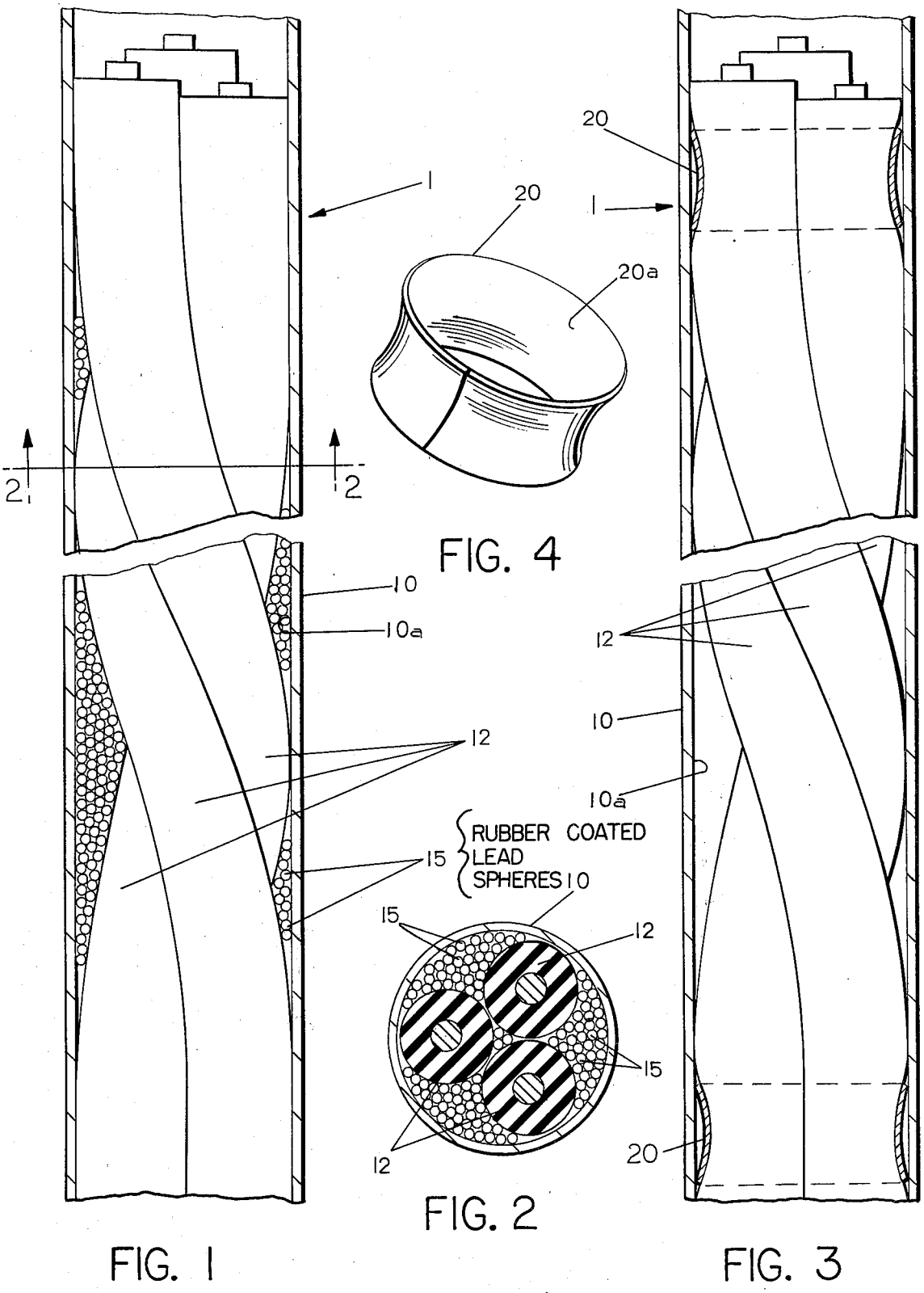
FIG. 1 is a vertical sectional view of a combined electrical and fluid well conduit embodying this invention wherein the compressible means for supporting the weight of the electrical wires constitutes a plurality of spheres having an elastomeric exterior.
FIG. 2 is a sectional view taken on the plane 2—2 of FIG. 1.
FIG. 3 is a view similar to FIG. 1 wherein the compressible support elements comprise a plurality of C-shaped spring rings which are spaced along the length of the electrical wires.
FIG. 4 is a perspective view of the C-shaped support ring employed in the modification of FIG. 3.

Referring to FIGS. 1 and 2 of the drawings, there is shown a combined pressured fluid and electrical conduit embodying this invention. Such conduit finds utility in the operation of pumps or heaters disposed in the lower regions of deep wells, such, for example, as described in the above-mentioned U.S. Pat. No. 4,262,226. The combined conduit includes an outer housing 10 formed of steel or other high tensile strength material capable of supporting the entire weight of the combustion conduit. One or more insulated electrical conductors 12 are pulled through the interior of the housing 10 and are twisted together in conventional fashion.

In accordance with this invention, all of the spaces between the insulated electrical conductors 12 and the internal walls 10*a* of the housing 10 are filled with a plurality of spheres 15 having an elastomeric exterior. The spheres 15 may be lead or other comparatively high density spheres coated with an elastomer, such as rubber, to permit some compressibility to align the spheres between the conductors 12 and the housing 10. It is desirable to provide wires which will not gravitate within the pressurized fluid column. Accordingly, the average density of the spheres and of the pressurized fluid should approximately equal the average density of the conductors 12. Such spheres are introduced into the open spaces by a pressured fluid with sufficient pressure to cause frictional support of the entire length of the electric wires 12 by the interior walls 10*a* of the outer housing 10. At the same time, it should be noted that the employment of the spheres inherently leaves fluid passages through the bore of the housing 10, which may be steel, for the transmission of pressured fluid to the down hole apparatus requiring such.

Referring now to FIGS. 3 and 4, there is shown an alternative embodiment of this invention wherein a plurality of compressible support elements 20 are provided in spaced relationship along the length of the insulated wires 12. Each support element may comprise a C-shaped ring formed either of elastomeric or steel spring material which can be opened to surround the wires 12 and then has to be compressed snugly against the exterior surfaces of the twisted wires 12 in order for the peripheral surface of the compressible ring 20 to be enterable within the interior walls 10*a* of the housing 10.

The internal surface 20*a* of the compressible C-ring 20 is of generally convex configuration as viewed in vertical section in order to provide snug engagement with the correspondingly shaped external surfaces of the twisted electrical wires 12. Pressured fluid may pass through the center of the twisted electrical wires 12 which is relatively unimpeded by the compressible support rings 20.

Figure 5:
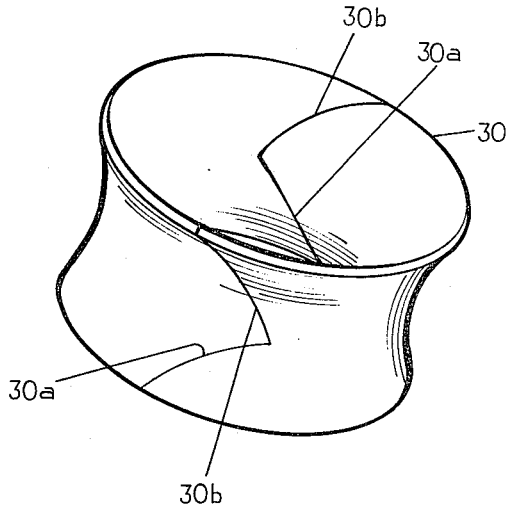
FIG. 5 is a perspective view of a segment form of support ring embodying this invention.
Figure 5A:
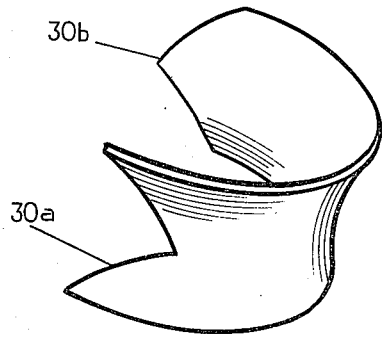
FIG. 5*a* is a perspective view of a single segment of the support ring of FIG. 5.

Still another form of this invention is illustrated in FIGS. 5 and 5*a* wherein the plurality of support elements 30 each comprises a pair of one hundred and eighty degree segments of the same general configuration as the C-ring shown in FIG. 4. The segments have matching slotted and projecting end surfaces 30*a* and 30*b* respectively so that when assembled around the wires 12, the outer periphery of the support element 30 will snugly engage the interior walls of the housing 10, and the segments are restrained against relative axial displacement.

Figure 6:
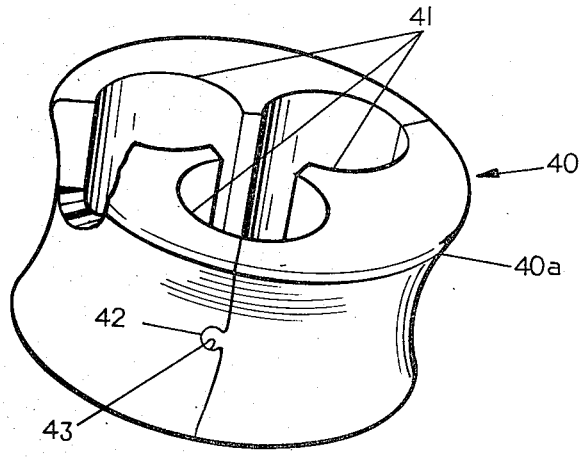
FIG. 6 is a perspective view of still another form of segment support ring embodying this invention.

Still another form of support element is illustrated in FIG. 6 wherein the support element 40 comprises three elastomeric segments which are respectively assembled around the three twisted wires 12 to form a unitary body having an external periphery 40*a* which is snugly engageable with the interior wall surface 10*a* of the housing 10. Each segment has internal recessed surface portions 41 which are respectively engageable with the external surfaces of the three twisted wires 12 when the segments are assembled around such wires and inserted within the housing 10. The adjacent segment surfaces are respectively provided with tongues 42 and grooves 43 to eliminate relative axial displacements.

As in the case of the modification of FIG. 4, fluid passages are provided downwardly through the center of the twisted wires 12, hence pressured fluid may be supplied to the apparatus located at the bottom of the housing 10.

The modifications of FIGS. 3–6 may be assembled in a continuous casing by pulling the electrical wires 12 thru the casing by a wire leader or by other means. The support elements are manually assembled to wires 12 at spaced intervals just prior to being pulled into the housing 10. Fluid pressure may be applied behind the inserted support elements to aid in the insertion.

If in some of the described modifications a larger fluid flow path is required, axial passages (not shown) may be provided in the support segments 40 of FIG. 6, and larger spheres 15 may be provided in the modification of FIGS. 1 and 2.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A conduit for concurrently transmitting electric power and pressured fluid to a utilization point within a subterranean well, comprising: a continuous cylindrical housing of sufficient length to extend from a well surface to a downhole utilization point; at least one insulated, electrically conductive wire passing through said housing; a plurality of spheres having a compressible surface packed into the space between said insulated, electric conductive wire and the interior bore of said cylindrical housing, whereby said insulated, electrically conductive wire is gravitationally stabilized within said housing and the spaces between said spheres provide a fluid passage therethrough for pressured fluid.

2. The conduit of claim 1 wherein the average density of the spheres is proportioned to the average density of the insulated, electrically conductive wire and the density of pressured fluid to be transmitted so that the average density of said spheres and the fluid to be transmitted is approximately equal to the average density of the insulated, electrically conductive wire.

* * * * *